United States Patent [19]

Spicer

[11] Patent Number: 4,662,791

[45] Date of Patent: May 5, 1987

[54] BUMPER ASSEMBLY SHOCK CELL SYSTEM

[75] Inventor: Earl E. Spicer, Houston, Tex.

[73] Assignee: Regal International, Inc., Corsicana, Tex.

[21] Appl. No.: 864,511

[22] Filed: May 19, 1986

[51] Int. Cl.[4] ..... B63B 21/04; E02B 3/22

[52] U.S. Cl. ..... 405/212; 114/219; 267/121; 405/211

[58] Field of Search ..... 405/211-215; 214/219, 220; 267/140, 121

[56] References Cited

U.S. PATENT DOCUMENTS

| | | | |
|---|---|---|---|
| 2,737,301 | 3/1956 | Thornhill | 405/212 X |
| 3,863,589 | 2/1975 | Guienne | 114/219 |
| 3,991,582 | 11/1976 | Waldrop | 405/213 |
| 3,995,437 | 12/1976 | Drewett | 114/219 |
| 4,005,672 | 2/1977 | Files | 114/219 |
| 4,043,545 | 8/1977 | Dial et al. | 405/212 X |
| 4,084,801 | 4/1978 | Landers | 267/140 |
| 4,098,211 | 8/1978 | Files et al. | 114/219 |
| 4,109,474 | 8/1978 | Files | 405/213 |
| 4,273,473 | 6/1981 | Thomerson et al. | 405/213 X |
| 4,311,412 | 1/1982 | Guilbeau | 405/212 |

*Primary Examiner*—Dennis L. Taylor

*Attorney, Agent, or Firm*—John F. Booth; Gerald G. Crutsinger; Norman L. Gundel

[57] ABSTRACT

An improved mechanism for cushioning shocks imparted to a stationary body from various sizes of vessels, including a resiliently retarded telescoping member having a first movement versus thrust characteristic with a relatively high rate of movement versus thrust over a first predetermined range of thrusts, and an abruptly lower rate of movement versus thrust for thrusts exceeding said first predetermined range.

20 Claims, 10 Drawing Figures

BUMPER ASSEMBLY SHOCK CELL SYSTEM

FIELD OF THE INVENTION

The present invention relates to offshore bumper systems for use in protection of offshore structures from damage from contacts with vessels such as boats, barges and the like, and in particular to shock cells with improved shock absorbing characteristics for use in these systems.

BACKGROUND

In the exploration and development of offshore petroleum reserves, it is often necessary to erect platforms located miles off shore. These platforms form a base on which drilling, exploration and storage activities can occur, and typically have legs or other types of support structure which extend down into the water. To transport men and material to and from these platforms, it is necessary to dock vessels alongside. In some situations, these vessels are small. In others, the vessels are quite large, and impact between these vessels and the platform leg structure can weaken or otherwise damage either the structure or the vessel itself.

To protect these platforms from damage due to contact by vessels operating near the platforms, bumper systems are attached to the platforms adjacent the water level and operate to fend off vessels and to absorb shocks from those vessels that come into contact with them.

These bumpers have found expression in a variety of constructions as exemplified by U.S. Pat. Nos. 3,991,582, 4,005,672, 4,098,211, 4,109,474 and 4,273,473. These basically include one or more surfaces for contact with the vessel or barge, and one or more shock-absorbing members interposed between the contact surfaces and the platform. The contact surfaces are chosen to provide a cushioning effect so as to spread the load on the hull surface over an area sufficient to prevent damage to the vessel. Thus, for example, one form of cushioning is provided by a plurality of resilient ring-like members that are disposed axially in a vertical configuration. A vertical pipe column maintains a stack of bumper rings on a common vertical axis and is supported top and bottom by one or more shock cells which absorb shocks. In some embodiments, a shock cell is provided at both top and bottom, while in others, a shock cell is installed at the top, and a resilient shear mounting is provided at the lower end.

Although the bumper systems (i.e., bumpers and shock cells) previously proposed have provided a marked improvement over arrangements having only bumpers, the provision of shock cells of suitable strength, resiliency, damping characteristic and cost have involved compromises due to the fact that they typically encounter vessels of a variety of sizes and shapes; and, consequently, the shock loads imparted to the bumpers/shock cells may vary widely. Moreover, even where vessels are of uniform size, varying sea conditions will result in greatly varying shock loads.

If a shock cell is designed to withstand the heavy loads resulting from large vessels in heavy seas, it may be insufficiently responsive to light loads imparted by small vessels and thereby cause damage to the small vessels. Correspondingly, if a shock cell is designed to have sufficient resiliency at low loads to properly cushion small vessels, it will be inadequate to provide the desired level of cushioning for larger vessels and thereby cause damage to the platform support. Accordingly, there has continued to be a need for a shock cell that incorporates good damping while providing levels of resiliency that accommodate a wide range of vessels under varying weather conditions.

BRIEF SUMMARY OF THE INVENTION

The shock cell of this invention overcomes the heretofore mentioned problems of widely varying loads by providing a plurality of ranges of resilient movement versus load. In the first range, a relatively light load such as that imparted by a small vessel results in a relatively large movement of the shock-absorbing member. When the load exceeds a predetermined level, another stage is activated. This next stage provides protection for larger vessels by including one or more much stiffer resilient members, i.e., a member or members having a much smaller travel versus load characteristic that to cushion the increased loads. It also improves the damping characteristic of the cell. Thus, the shock cell is able to provide protection for the entire range of vessel sizes and sea states that are expected to be encountered.

OBJECTS AND FEATURES

It is one general object of this invention to improve shock cells.

It is another object of this invention to extend the range of loads for which a shock cell provides protection.

It is still another object of this invention to provide an extended range shock cell which can be manufactured at acceptable cost.

It is still another object of this invention to provide an extended range shock cell which is compatible in exterior configuration with many popular designs and therefore readily lends itself to replacement thereof.

It is yet another object of the invention to improve damping characteristics while at the same time extending the range of loads under which the cell is operable.

Accordingly, in accordance with a feature of the invention, a plurality of elastomers of differing resiliency characteristics are employed in a predetermined geometric configuration thereby to provide an enhanced range of protection.

In accordance with another feature of the invention, the plurality of elastomers are positioned in sequence within the shock cell housing to provide tandem activation, and imparting to the cell a first soft range of resiliency followed by a hard range of resiliency, thereby to cushion both light and heavy loads without damage to load-imparting vessels.

In accordance with still another feature of the invention, the housing of the shock cell comprises a pair of telescoping elements effectively connected through a first range of loads by a first elastomer only and thereafter through a plurality of elastomers, thereby providing improved shock absorbing and damping characteristics.

In accordance with yet another feature of the invention, the housing of the shock cell comprises a pair of telescoping elements effectively connected through a first range of loads by a first elastomer only, through a second higher range of loads by another elastomer of lesser resiliency, and upon application of still additional load, by an internal bumper member of predetermined characteristics, thereby further increasing the range of operable loads.

In accordance with still another feature of the invention, first and second elastomeric materials are disposed within the shock cell housing in geometrical alignment thereby permitting the retention of a uniform diameter exterior cylinder and contributing to ease of manufacture, reduction in cost and, in some instances, ease of replacing existing shock cell parts.

In accordance with yet a further feature of the invention, an improved internal thrust transfer arrangement is provided to effect a smooth transition from single to dual elastomer activation.

These and other objects and features will be apparent from the following detailed description of a preferred embodiment with reference to the drawing.

DETAILED DESCRIPTION OF A PREFERRED EMBODIMENT

Figure 1:
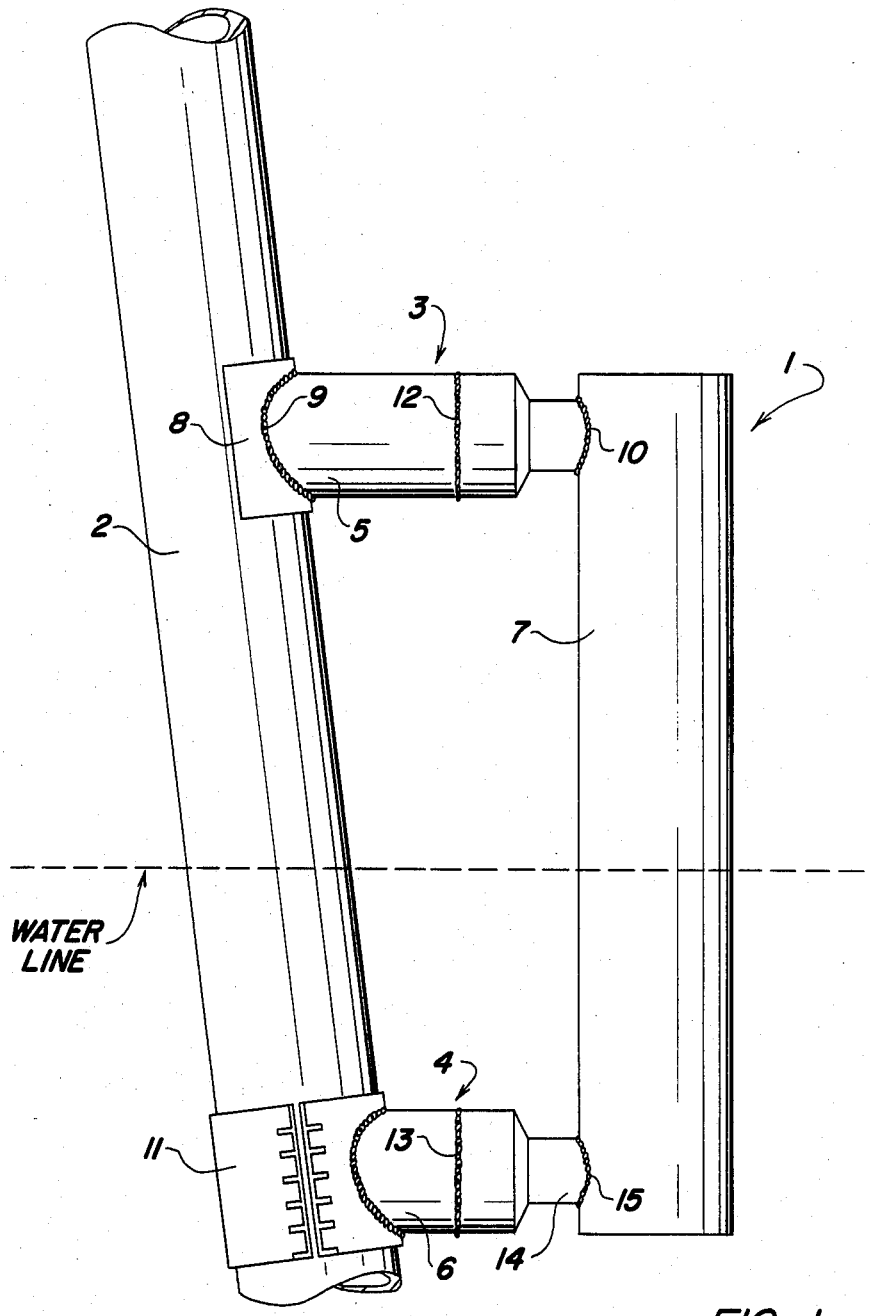
FIG. 1 is a side elevation view depicting a typical installation of a bumper and a pair of shock cells to protect an offshore platform.

Now turning to the drawing and more particularly FIG. 1 thereof, it will be observed that it depicts a combination bumper and shock cell 1 that, in general, is typical of the prior art. The combination bumper and shock cell 1 is shown in an exemplary installation attached to a vertically extending structural member 2. The structural member 2 can be the leg or other structural portion of an offshore platform, jackup, submersible or semi-submersible rig or the like. It is also envisioned that structural member 2 could represent a portion of a pier or piling of a dock, wharf, quay or similar structure.

Assembly 1 is shown attached to the structural member 2 with its upper part above, and with its lower part below, the water level. Assembly 1 is positioned to provide protection for the structural member 2 by fending off boats, barges and other vessels which may, by accident or necessity, come into contact with the structural member 2. It is also envisioned that the assembly 1 could be utilized to protect fluid-carrying conduits such as standpipes and the like, from impact damage due to contact with vessels.

The assembly 1 is supported from the member 2 by upper and lower horizontally extending support assemblies 3 and 4. respectively. The assembly 1 is designed to provide a contact surface spaced away from the member 2 and has resilient means for absorbing the shock imparted to the assembly by vessels contacting the assembly. The assembly reduces the maximum shock loads transferred to the members 2 by contact with the vessel.

The upper and lower support assemblies 3 and 4 comprise upper and lower generally horizontally extending arms 5 and 6 which preferably may be made of tubular metallic material of suitable strength and durability. In the present embodiment, the upper extending arm 5 includes within it an improved shock cell of the type hereinafter described. The lower extending arm 6 may optionally include one of the improved shock cells or it may, where lighter load conditions are expected, provide a direct but pivotable support and connection between the lower part of the bumper 7 and the structural member 2. For clarity of description, the embodiment shown in FIG. 1 depicts such a direct support and connection for the lower extending arm 6, with the pivoting feature being provided between parts 14 and 6; or alternatively, it may include the type of pivot shown in U.S. Pat. No. 4,005,672.

The mode of connection between the ends of upper and lower extending arms 5 and 6 and structural member 2 and bumper 7 is not critical so long as it provides adequate strength and durability. In the embodiment depicted, arm 5 is fastened to member 2 by the use of flange 8 connected through weld 9, the flange 8 being affixed to structural member 2 by conventional means (not shown) such as clamping or welding. The opposite end of arm 5 is shown as being welded directly by weld 10 to bumper 7. However, there may be instances in which a more readily releasable connection is desired. In such instances, the connections may be made with clamps or sleeves such as shown at 11 for the lower extending arm 6 and shown in detail in U.S. Pat. No. 4,005,672.

Upper and lower extending support assemblies 3 and 4 are shown as including additional welds 12 and 13. These welds facilitate assembly of the internal shock cell components as will be observed from the detailed description below. However, in some instances if it is desired to include a shock cell in the upper arm only, it may be advantageous to eliminate weld 13 as, for example, by using one instead of two lengths of uniform diameter material.

As mentioned above, lower extending arm 6 is shown as being secured to structural member 2 by clamp 11 since it is difficult and/or expensive to make welds underwater.

As the lower extending arm 6 ordinarily would be joined with bumper 7 before attachment to structural member 2 and while the bumper assembly was out of water, the remaining end 14 may be joined to bumper 7 by weld 15.

Bumper 7 may take the form of any of a number of resilient configurations known in the prior art. As mentioned above, its important characteristics can include resiliency, resistance to abrasion and wear, and the ability to spread shock loads over a sufficient hull area of an adjacent vessel so as to eliminate or minimize damage thereto. Representative examples of bumper constructions are found in U.S. Pat. Nos. 3,991,582, 4,005,672 and 4,109,474.

Figure 2:
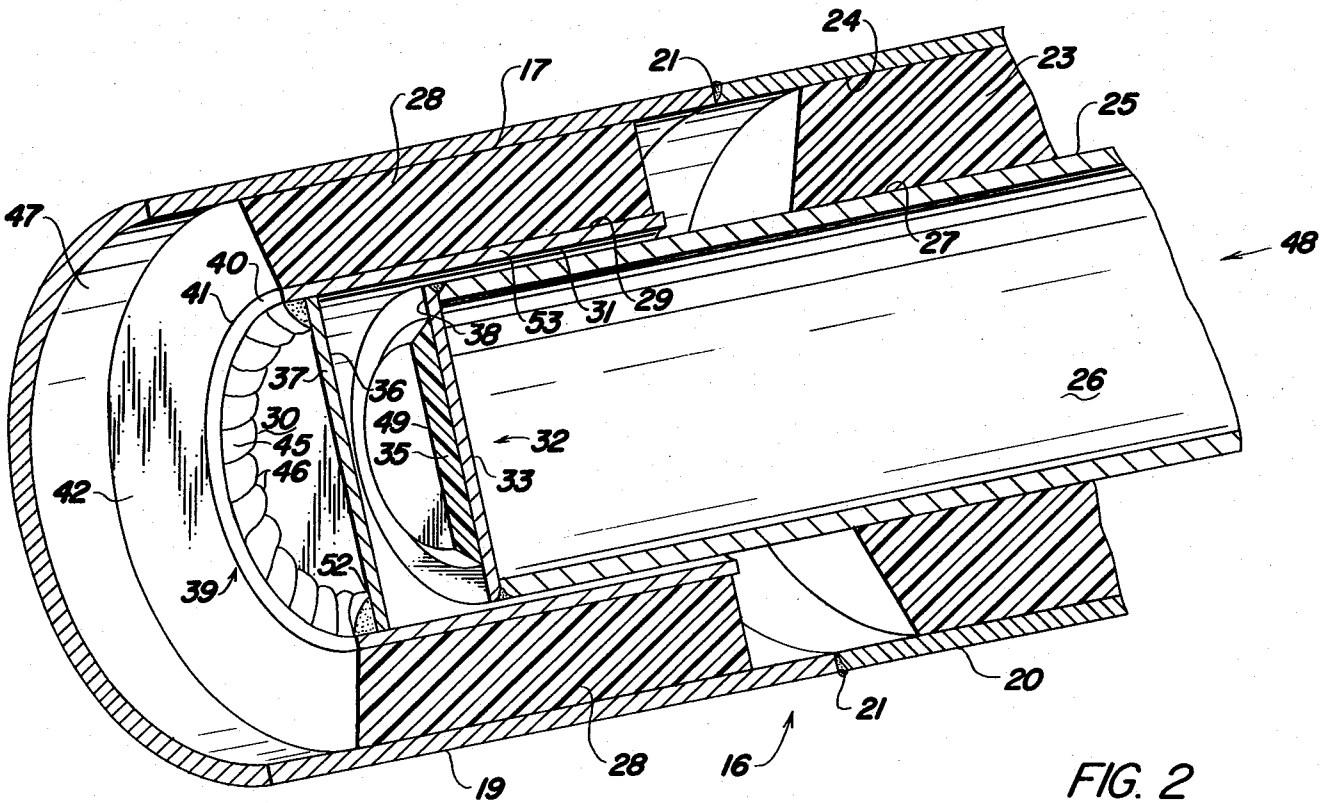
FIG. 2 is a perspective sectional view of one shock cell embodiment of the invention.

Now turning to FIG. 2, it will be observed that there is shown in sectional perspective view, one embodiment of a shock cell according to the invention. This cell, generally shown at 16 comprises an outer cylindrical housing 17 which may be fabricated in several sections as, for example sections 19 and 20. These sections may be joined by welding as is shown at weld 21. Alternatively, other conventional ways could be employed to fasten these sections together. Thus, they could be threaded with mating threads so that they could be screwed together. However, in order to economically produce the completed cell, it is desirable to fabricate it in parts and then assemble it as shown in FIG. 2.

To assist in accurately describing the shock cell it will be helpful to define two terms: Low Resiliency Coefficient and High Resiliency Coefficient. By Low Resiliency Coefficient is meant the quality of a material to change in shape a relatively small amount in response to the application of a load; whereas High Resiliency Coefficient means the quality of a material to change in shape a relatively large amount in response to the application of a load.

Within housing 17 there are disposed a plurality of elastomeric materials which preferably are made of rubber. The first of these is annulus 23 which extends completely around the interior 24 of housing 17 and is bonded by known techniques to its interior surface (as shown) and to the exterior surface 25 of telescoping cylindrical member 26. The elastomeric material of annulus 23 has a High Resiliency Coefficient, that is, the material will change shape readily in response to a relatively light load; and it is this characteristic of the material in annulus 23 that provides the very responsive cushioning that will protect small boats.

As will be observed, the geometry of the cross section of annulus 23 is trapezoidal. However, it could be rectangular or of another geometry, since its precise shape is not critical.

Also within housing 17 is a second annulus 28 of elastomeric material. The material of this second annulus is chosen to display a markedly lower Resiliency Coefficient than that of first annulus 23 and thus is able to withstand greatly increased loads. As will be observed, this second annulus is bonded to the inner surface of housing 17 and to the outer surface 29 of an inner well assembly generally shown at 30. Since it is not bonded to interior telescoping member 26, it is inactive until deflection of the cell exceeds a predetermined threshold.

Now returning to telescoping member, it will be observed that its outer surface 25 is smaller in diameter than the inner surface 31 of interior well assembly 30, thereby permitting relative movement therebetween. In addition, telescoping member 26 includes at its inboard end 32 a closure plate 33 which serves as a seal between the adjacent interior compartments and as a support for buffering and engaging element 35. Buffering element 35 engages the inner surface 36 of pressure plate 37 when interior telescoping member 26 moves inwardly beyond a predetermined distance and thus serves to activate second annulus 28.

Engaging element 35 can be in the shape of a truncated cone (as shown) and is bonded to outer surface 38 of closure plate 33 by known techniques. It is made of very strong material and therefore is capable of imparting sufficient force to plate 37 to cause travel of the interior well assembly 30 to a position corresponding to that shown in FIG. 4 if the force on the shock cell is sufficient.

At the inboard end 39 of inner well assembly 30 there is an extension 40 of the walls of the well assembly, and completing the interior of the cell is void 47.

In operation, thrust, generally designated by arrow 48, is imparted to interior telescoping member 26. It is this thrust that is meant when referring to shock cell load. The thrust may be in axial alignment with the longitudinal axis of the cell, (as shown) or it may be at an angle thereto. However, in practice, the major component of thrust will ordinarily be in axial alignment. As this thrust increases from zero, the elastomeric material of the first annulus 23 will begin to change shape correspondingly. As telescoping member 26 travels inwardly in response to the thrust, the elastomeric material gradually and increasingly resists the increasing thrust. After an appreciable travel, outer surface 49 of buffering element 35 engages inner surface 36 of pressure plate 37, thereby initiating conduction of thrust thereto. As the thrust at 48 continues to rise, the increased travel of telescoping member 26 results in an increasing part of the thrust being imparted to interior well assembly 30 and thence to second elastomeric material annulus 28.

Pressure plate 37 may be of steel or other suitable material to provide transition between the effects of the two annuli 23 and 28 of differing characteristics.

Figure 3:
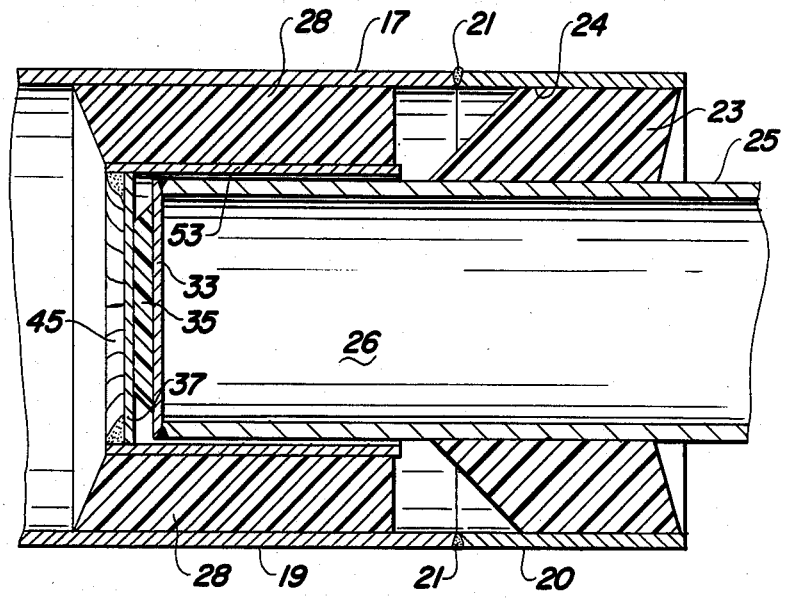
FIG. 3 is a cross section view of the invention showing the condition of the telescoping tubular element and main resilient elastomers when the cell is subjected to light loads.
Figure 4:
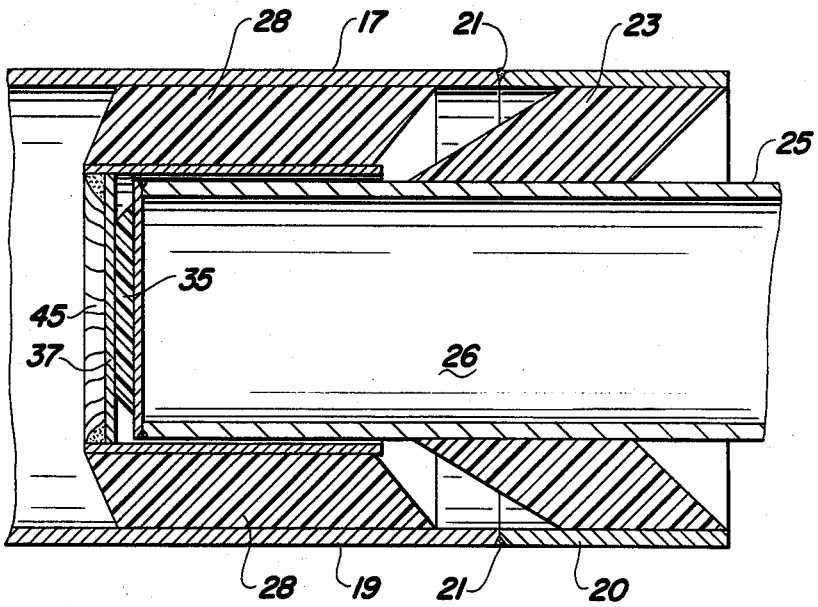
FIG. 4 is a cross section of the embodiment of FIGS. 2 and 3 showing the condition of the telescoping tubular element and both main resilient elastomers when the cell is subjected to heavy loads.

FIGS. 3 and 4 depict the embodiment of the shock cell of FIG. 2 in side sectional view. FIG. 3 depicts the conditions of the elastomeric annuli 23 and 28 when the cell is subjected to loading at the upper end of the range for which first annulus 23 is designed to act alone. It will be observed that interior telescoping member 26 has moved inwardly in response to loading sufficiently to bring element 35 and plate 37 into complete engagement. Thereafter, any further increase in loading results in transfer of a major part of the incremental increase from telescoping member 25 through end plate 33, engaging element 35, plate 37, and wall 53 to activate second elastomeric annulus 28.

As heretofore mentioned, elastomeric material 28 is much stiffer than material 23 and consequently will deform substantially less per incremental unit of loading. Accordingly, while both elements 23 and 28 will deform in response to the application of additional load, the major part of additional incremental load is accepted by element 28.

Although in the preferred embodiment herein described, the difference in characteristics of the two different materials is advantageously utilized to obtain the differing characteristics of travel vs load, it will be evident to one skilled in the art that the desired characteristics could be obtained by the use of similar materials but embodied in annuli of different geometries. Thus, for example if anulus 23 and 28 were made of similar material and if annulus 28 were to be elongated so as to present a much greater cross-sectional area than annulus 23, it would present a greater resistance to movement, thereby accomplishing a similar result.

FIG. 4 shows the cell of FIG. 3 when stressed with a heavy load. Here, it will be seen, that both elastomeric elements 23 and 28 are contributing to absorbing load. Element 23 is increasingly deformed with respect to the condition depicted in FIG. 3, and element 28 has deformed inwardly in response to the force. By selecting the respective resilience coefficients, a wide range of operability can be imparted to the shock cell.

It should be noted that in unusual environments such as those in which icebergs or raging seas may be encountered, an even greater range of bumpering may be desired. In such event, the principles of this invention could readily be extended to include one or more additional telescoping members tandemly activated to increase the range of protection. Thus, for example, an additional telescoping member could be employed within member 26 and could be resiliently connected thereto in a fashion similar to that depicted for the embodiments illustrated herein.

Figure 5:
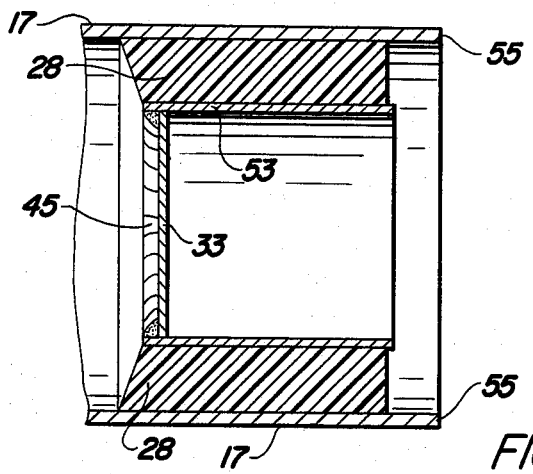
FIG. 5 is a cross section of a part of the embodiment of FIGS. 2, 3 and 4 showing a portion of the outer tubular element when disengaged from its mating section.

FIG. 5 shows a part of the shock cell of FIGS. 2, 3 and 4 prior to its assembly with the remaining parts. Here, it will be seen that it includes a portion of outer housing 17 (a part of the housing forward of assembly weld 21), low resiliency coefficient annulus 28 bonded in the manner described with respect to FIG. 2, closure plate 33, weld 45, and wall member 53.

Figure 6:
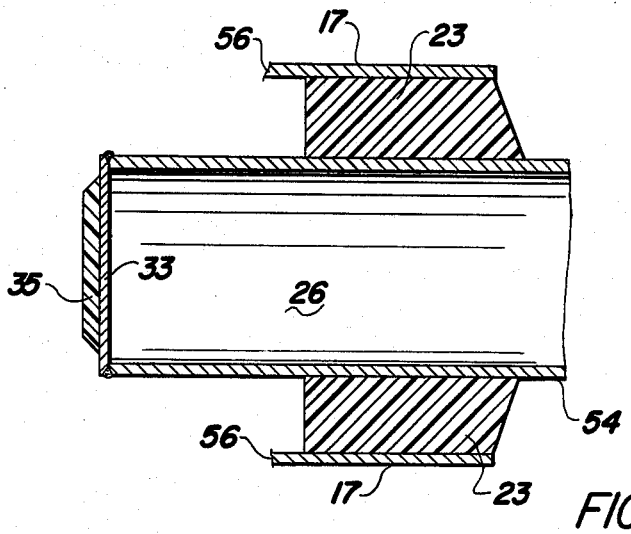
FIG. 6 is a cross section of a part of the embodiment of FIGS. 2, 3 and 4 showing the inner tubular element that telescopes within a portion of FIG. 5.

FIG. 6 shows the interior telescoping part 26 of the shock cell of FIGS. 2, 3 and 4 prior to its assembly with the remaining part (FIG. 5). Here it will be seen that it includes high resiliency coefficient annulus 23 bonded to the adjacent metallic surfaces in the manner described with respect to FIG. 2, telescoping cylinder 54 with end closure plate 33 and engaging element 35. Here, it will be observed, the unloaded geometry of elastomeric annulus 23 is different from that shown for the corresponding member in FIG. 2 and is thus depicted to illustrate the point that the annuli may take different shapes depending upon the characteristics desired therein.

When it is desired to assemble the parts of FIGS. 5 and 6, it is merely necessary to bring them together and insert the inboard end of telescoping cylinder 54 (FIG. 6) into the mating cavity within the assembly of FIG. 5 until the corresponding ends 55 and 56 abut. A welding bead such as that of 21 in FIGS. 2–4 is then run about the periphery to seal the two sections together. Although this is the form of connection shown in the drawings, it should be understood that other forms could be employed. Thus, for example, portions of the exterior surfaces 17 adjacent the points of connection could be threaded, and a heavy duty internally threaded coupling could be employed to complete the assembly.

Figure 7:
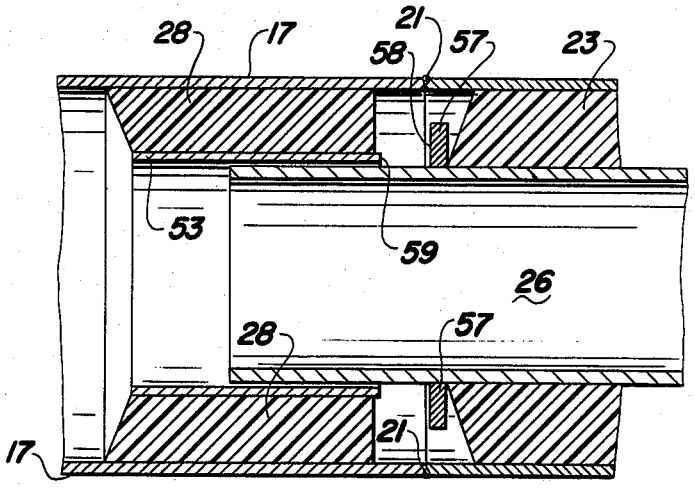
FIG. 7 is a cross section of an embodiment similar to that of FIGS. 2, 3 and 4 but having a different arrangement for activating the second elastomer.

FIG. 7 shows an alternate way of transferring loads to elastomeric annulus 28. Here, the load is transferred by way of engaging ring 57 which encircles inner telescoping member 26 and is affixed thereto by any suitable means such as welding. When the cell is activated to the upper range of design for elastomeric annulus 23 alone, inner member 26 moves inwardly sufficiently to bring inner surface 58 into engagement with end 59 of wall 53 thereby transferring the major part of additional incremental thrust therethrough and into annulus 28.

Figure 8:
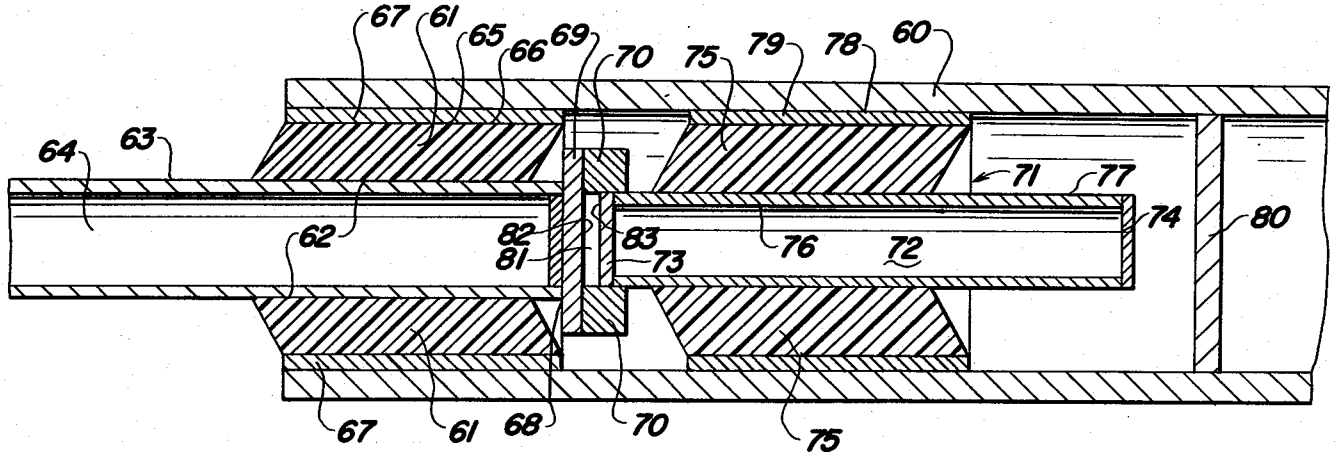
FIG. 8 is a cross section of an embodiment basically similar to that of FIGS. 3 and 4 but having different internal geometries and a still different arrangement for activating the second elastomer.

FIG. 8 depicts still another alternate form of the invention. Here, it will be seen, is an exterior housing 60 similar to housing 17, first interior elastomeric annulus 61, similar to annulus 23, bonded about its interior periphery 62 to the outer surface 62 of first telescoping cylinder 64 and bonded about its exterior surface 65 to the interior surface 66 of connecting member 67. Also included is a connecting assembly affixed to the inboard end 68 of telescoping cylinder 64. This contacting assembly comprises end member 69 and ring portion 70. This ring portion 70, which may optionally be fitted with an intervening resilient contact member (not shown) acts as a sleeve within which a mating part of the adjacent assembly 71 is guided as will be described hereinafter.

Inner assembly 71 comprises an inner telescoping cylindrical member 72 having impact plates 73 and 74 welded or otherwise affixed to the ends thereof, a second elastomeric annulus 75 bonded at its inner surface 76 to exterior surface 77 of telescoping cylindrical member 72 and bonded at its outer surface 78 to the inner surface of connecting member 79. Also within housing 60 is a stop plate 80 which limits interior travel of telescoping cylinders 64 and 72.

The connecting members 67 and 79 permit ease of assembly and elimination of a weld corresponding to 21 in the earlier figures. Thus, the interior portion of housing 60 that abuts these connecting members can be threaded (not shown), and the exterior surfaces of the connecting members in contact therewith can readily be fitted with corresponding threads, thus permitting the assembly by screwing the members into the desired position. This also facilitates adjustment of the members to provide the desired longitudinal dimension for space 81 and the permissible length of travel before end 74 of member 72 contacts stop plate 80.

When the cell of FIG. 8 is unstressed, there exists a space 81 which is provided to permit travel of telescoping cylinder 64 without at first engaging telescoping cylinder 72. As was with the earlier described embodiments of the invention, the material of first elastomeric annulus 61 is such that it moves rapidly with increasing stress, thus having what is called herein a high coefficient of resiliency. Accordingly, as with the other embodiments, elastomeric annulus 61 provides the soft cushioning required to protect small boats. After first telescoping cylinder 64 has traveled inwardly sufficiently to eliminate space 81, surfaces 82 and 83 come into direct contact, thereby resulting in the transfer of at least a major part of any additional increase in thrust to second elastomeric annulus 75. Thereafter, further increases in thrust cause both elastomeric annuli to deform and absorb thrust until travel results in contact of impact plate 74 with stop plate 80, thus providing a limit to protect the elastomeric materials from rupture.

Figure 9:
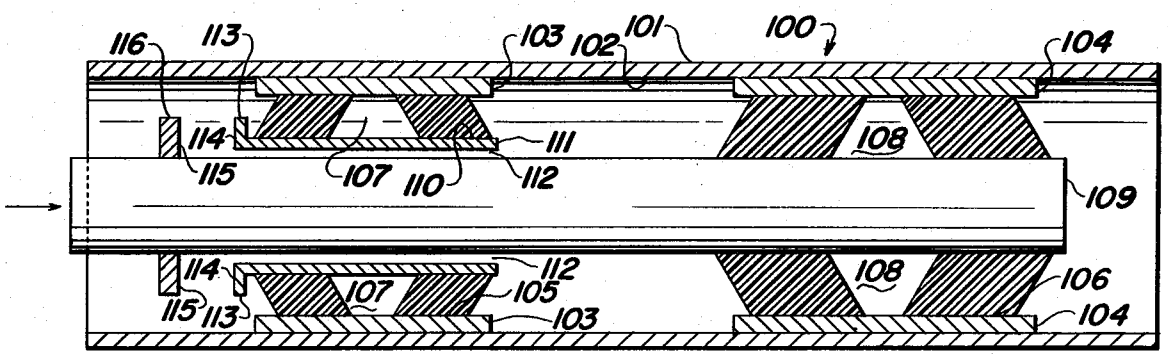
FIG. 9 is a cross section of an embodiment in which an inner elastomeric annulus first accepts thrust load and an outer annulus accepts the major part of any incremental thrust loads beyond a predetermined threshhold.

In the examples hereinabove described, it is the outer elastomeric annulus which first accepts thrust-imparted loading and provides the initial resiliency, the inner elastomeric annulus providing the additional load-bearing characteristic required for buffering of heavier loads. It is not necessary, however, that the materials be thus positioned. For example, the positions of the annuli can readily be exchanged as is shown in the embodiment of FIG. 9. There, it will be observed, is a shock cell generally shown at 100 with an outer housing 101 having an inner surface 102 to which annuli connecting members 103 and 104 are affixed. To these annuli connecting members 103 and 104, respectively, are affixed the outer surfaces 105 and 106 of elastomeric annuli 107 and 108. Although connecting members 103 and 104 are shown to illustrate interconnection of the elastomeric annuli 107 and 108 to inner surface 102 of housing 101, and although in some instances they may provide ease of assembly, it is not necessary that they be included, for the elastomeric annuli may be affixed directly to the inner surface 102 as is shown in FIGS. 2–7.

Elastomeric annulus 108 is affixed to the inboard part of telescoping member 109; however, the inner surface 110 of annulus 107 is affixed to sleeve member 111 which is separated from the outer surface of telescoping member 109 by space 112, thus permitting unimpeded movement therebetween. As will be observed, sleeve member 111 is fitted with flange portion 113 which has surface 114 that is adapted for engagement with surface 115 of collar 116. Collar 116 is affixed to telescoping member 109.

In operation, when thrust (shown by arrow 117) is applied to the telescoping member 109, it is imparted first to inner elastomeric annulus 108 which then correspondingly deforms in response thereto. After telescoping member 109 has moved inwardly a predetermined distance (and annulus 108 has accepted a predetermined level of load), surface 115 engages surface 114, after which further increase in loading (and corresponding travel of telescoping member 109) results in application of a part of any incremental loading to outer elastomeric annulus 107. As mentioned above, the differing characteristics of the annuli are achieved either through making them of materials having different resiliency coefficients or through disposing them in different geometrical configurations, e.g., configurations that employ differing amounts of material as by extending or shortening the lateral dimension of one of the annuli.

Figure 10:
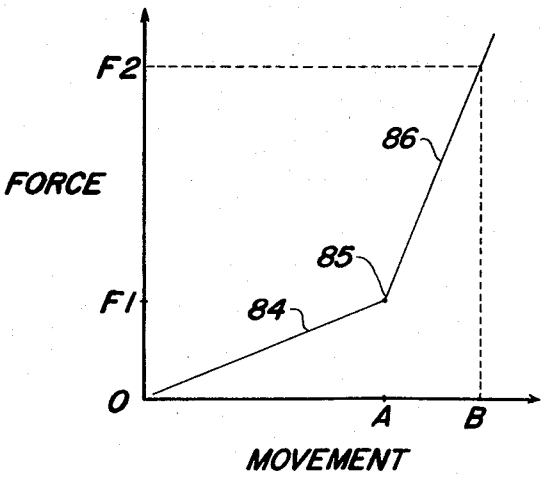
FIG. 10 is a diagram showing force versus movement characteristics typical of the improved shock cell of this invention.

FIG. 10 is a graph illustrating the typical response of the shock cells to increasing loads. As will be observed, the ordinate is the force (thrust, or load) applied to the cell, and the abscissa is the resulting deflection of the cell, i.e., movement of the telescoping member within the housing. Here one observes clearly the effect of tandem activation of the elastomeric elements. As load is applied, the first highly resilient elastomeric member accepts it and the telescoping member moves relatively easily as shown by part 84 of the graph until the force equals that of F1. At that point, the telescoping member has moved inwardly an amount represented by point A. Thereafter, at point 85, the relatively stiff second elastomeric member is activated, after which the application of further thrust brings about travel according to part 86 of the graph. Thus, a force equal to F2 results in travel to a point represented by B.

It will now be observed that there has been described herein an improved shock cell that provides substantial advantages in versatility of application, increase in range of acceptable loads, enhancement of damping and effectiveness in cost.

Although the invention hereof has been described by way of examples of preferred embodiments, it will be evident that other adaptations and modifications may be employed without departing from the spirit and scope thereof. For example, as mentioned above, in some embodiments the elastomeric materials could have the same or similar resiliency coefficients, and the desired differences in deflection versus load characteristics of the two annuli could be achieved by making the quantity or geometry of material in one annulus substantially different from the other.

The terms and expressions employed herein have been used as terms of description and not of limitation; and thus, there is no intent of excluding equivalents, but on the contrary it is intended to cover any and all equivalents that may be employed without departing from the spirit and scope of the invention.

What is claimed is:

1. A bumper assembly for connection to one or more vertical structural members of oil drilling platforms and the like, comprising a contact member for engagement with the hull of a vessel, supporting means supporting said contact member in a vertical position, said supporting means comprising an upper support member and a lower support member each having an inner portion connected to one of said structural members and an outer portion affixed to said contact member, at least one of said upper and lower support members comprising: a longitudinal sleeve having a first cross sectional dimension, another longitudinal member of lesser cross sectional dimension adapted for telescoping engagement with and within said sleeve, first regressively resilient means interconnecting said other longitudinal member with said sleeve, said first resilient means having a relatively low force versus displacement characteristic and being responsive to thrust imparted to said other longitudinal member by said contact member to absorb the major part of said thrust over a range from zero to a first predetermined level sufficient to cushion impact from small vessels, second regressively resilient means within said sleeve, inactivating means rendering said second regressively resilient means normally inactive, and means responsive to thrust imparted to said contact member for effecting temporary interconnection through said second resilient means between said other longitudinal member and said sleeve only so long as said thrust exceeds said first predetermined level, thereby to activate said second resilient means only so long as said thrust exceeds said first predetermined level.

2. A bumper assembly according to claim 1 in which said longitudinal sleeve is cylindrical.

3. A bumper assembly according to claim 1 in which said other longitudinal member is cylindrical.

4. A bumper assembly according to claim 1 in which both said longitudinal sleeve and said longitudinal member are cylindrical.

5. A bumper assembly according to claim 1 in which said inactivating means includes a cavity having one closed end and the other end adapted to receive one end of said other longitudinal member and, in the absence of thrust, to contain a longitudinal space between said closed end and said one end, and wherein, in response to application of thrust equal to said predetermined level, said one end telescopes inwardly to directly engage said closed end.

6. A bumper assembly according to claim 5 in which said first resilient means is affixed to an inner surface of said sleeve.

7. A bumper assembly according to claim 5 in which said first resilient means is affixed to the outer surface of said other longitudinal member.

8. A bumper assembly according to claim 5 in which said first resilient means is affixed at its outer surface to an inner surface of said sleeve and in which said first resilient means is also affixed at its inner surface to the outer surface of said other longitudinal member.

9. A bumper assembly according to claim 5 in which said second resilient means is affixed at its outer surface to an inner surface of said sleeve.

10. A bumper assembly according to claim 5 in which said second resilient means is affixed at its inner surface to an outer wall of said cavity.

11. A bumper assembly according to claim 5 in which said second resilient means is affixed at its outer surface to an inner surface of said sleeve and in which said second resilient means is also affixed at its inner surface to the outer surface of a wall of said cavity.

12. A bumper assembly according to claim 5 in which said first and second resilient means are affixed at their outer surfaces to inner surfaces of said sleeve, said first resilient means is also affixed at its inner surface to the outer surface of said other longitudinal member, and said second resilient means is also affixed at its inner surface to the outer surface of a wall of said cavity.

13. A bumper assembly according to claim 1 in which there is included within said sleeve a cavity having one closed end and the other end adapted to receive one end of said other longitudinal member and into which said other longitudinal member telescopes progressively in response to progressively increasing thrust imparted to said other longitudinal member, said second resilient means including a ring of resilient material affixed at its outer surface to an inner wall of said sleeve and at its inner surface to the outer surface of the wall of said cavity, said inactivating means including a projection extending outwardly from the outer wall of said other longitudinal member at a predetermined location to impact the end of the wall of said cavity only when thrust and resulting progressive telescoping of said other longitudinal member surpasses a predetermined level.

14. A shock cell according to claim 13 in which said first resilient means includes a ring of resilient material affixed at its outer surface to an inner wall of said sleeve and at its inner surface to an outer wall of said other longitudinal member.

15. A shock cell comprising a first longitudinal member having a first cross sectional dimension, a second longitudinal member having a lesser cross sectional dimension and being adapted for telescoping into said first member upon the application of axial thrust thereto, first resilient means having a first predetermined thrust resistance characteristic within said first member interconnecting said first and second members and responsive to incremental increases in said axial thrust to resiliently and progressively deform in shape correspondingly and thereby absorb at least a major part of said thrust, second normally inactive resilient means having a different predetermined thrust resistance characteristic within said first member, and means effective when said thrust exceeds a predetermined level for activating said second resilient means and thereafter, upon application of additional incremental thrust, to deform said second resilient means progressively to absorb at least a part of said additional incremental thrust.

16. A shock cell comprising a first longitudinal member having a first cross sectional dimension, a second longitudinal member having a lesser cross sectional dimension and being adapted for telescoping into said first member upon the application of axial thrust thereto, first resilient means having a first predetermined thrust resistance characteristic within said first member interconnecting said first and second members and response to incremental increases in said axial thrust to resiliently and progressively deform in shape correspondingly and thereby absorb at least a major part of said thrust, second normally inactive resilient means having a different predetermined thrust resistance characteristic within said first member, and means effective when said thrust exceeds a predetermined level for activating said second resilient means and thereafter, upon application of additional incremental thrust, to deform said second resilient means progressively to absorb the major part of said additional incremental thrust.

17. A shock cell comprising a first longitudinal member having a first cross sectional dimension, a second longitudinal member having a lesser cross sectional dimension and being adapted for telescoping into said first member upon the application of axial thrust thereto, first resilient means of high resiliency coefficient within said first member interconnecting said first and second members and responsive to incremental increases in said axial thrust to resiliently and progressively deform in shape correspondingly and thereby absorb a major part of said thrust, second normally inactive resilient means of substantially lower resiliency coefficient within said first member, and means effective when said thrust exceeds a predetermined level for activating said second resilient means and thereafter, upon application of additional incremental thrust, to deform said second resilient means progressively to absorb the major part of said additional incremental thrust.

18. A shock cell comprising a cylindrical housing having a predetermined diameter and wall thickness; a first thrust-responsive assembly having a first inner longitudinally disposed thrust accepting member having inner and outer ends, a first connecting cylinder having an outer diameter essentially equal to the inner diameter of said cylindrical housing, a first annulus of elastomeric material of high resiliency coefficient affixed over its inner surface to an outer surface of said first thrust accepting member and over its outer surface to the inner surface of said first connecting cylinder, and a thrust communicating plate affixed to the inner end of said first thrust accepting member; a second thrust responsive assembly having a second inner longitudinally disposed thrust accepting member with two ends, a second connecting cylinder having an outer diameter essentially equal to the inner diameter of said cylindrical housing, a second annulus of elastomeric material of low resiliency coefficient affixed over its inner surface to an outer surface of said second thrust accepting member and over its outer surface to the inner surface of said second connecting cylinder; and mounting means for mounting both said assemblies within said cylindrical housing in axial alignment and in close proximity thereby to provide a space of predetermined size between said inner end of said first thrust accepting member and the adjacent end of said second thrust accepting member when the cell has no thrust imparted to it.

19. A shock cell according to claim 18 wherein said first and second cylinders each include threaded portions, and the inner surface of said cylindrical housing includes corresponding threaded portions adapted for engagement with the threaded portions of said first and second cylinders.

20. A shock cell according to claim 18 wherein within said cylindrical housing and near one end thereof there is disposed a stop plate spaced a predetermined distance from one end of the position of the adjacent end of said second thrust accepting member when said second thrust accepting member has no thrust.

* * * * *

UNITED STATES PATENT AND TRADEMARK OFFICE

CERTIFICATE OF CORRECTION

PATENT NO. : 4,662,791

DATED : May 5, ]987

INVENTOR(S) : Earl E. Spicer

It is certified that error appears in the above-identified patent and that said Letters Patent is hereby corrected as shown below:

In Column 7, line 67, change 62 (second occurrence) to -- 63 --.

Signed and Sealed this

Eighth Day of September, 1987

*Attest:*

DONALD J. QUIGG

*Attesting Officer*

*Commissioner of Patents and Trademarks*